US005192305A

United States Patent [19]

Sastre

[11] Patent Number: 5,192,305

[45] Date of Patent: Mar. 9, 1993

[54] PROCESS AND APPARATUS FOR PHYSIOTHERAPY IN SCOLIOSIS AND DEVIATIONS OF THE RACHIS IN GENERAL

[76] Inventor: Santos F. Sastre, Balmes no. 89 -30 1a, 08008 Barcelona, Spain

[21] Appl. No.: 714,185

[22] Filed: Jun. 14, 1991

[30] Foreign Application Priority Data

Jun. 15, 1990 [ES] Spain ..... 9001779

[51] Int. Cl.[5] ..... A61H 1/02

[52] U.S. Cl. ..... 606/241

[58] Field of Search ..... 128/69, 75, 78; 606/241

[56] References Cited

U.S. PATENT DOCUMENTS

| | | | |
|---|---|---|---|
| 32,014 | 4/1861 | Taylor | 128/69 |
| 41,548 | 2/1864 | Taylor | 128/69 |
| 963,890 | 7/1910 | Haas | 128/75 |
| 3,353,532 | 11/1967 | Ellis | 606/241 |
| 4,112,935 | 9/1978 | Latypov et al. | 128/75 |
| 4,896,659 | 1/1990 | Goldish | 128/75 |
| 5,018,512 | 5/1991 | Dolan | 128/75 |
| 5,033,460 | 7/1991 | Goldish | 128/75 |

FOREIGN PATENT DOCUMENTS

| | | | |
|---|---|---|---|
| 0209952 | 5/1957 | Australia | 128/75 |
| 0625486 | 8/1961 | Canada | 128/75 |
| 0812280 | 3/1981 | U.S.S.R. | 128/75 |

*Primary Examiner*—Richard J. Apley
*Assistant Examiner*—Lynne Reichard
*Attorney, Agent, or Firm*—Jacobson, Price, Holman & Stern

[57] ABSTRACT

For treating scoliosis and deviations of the human spinal cord in general, a patient is supended under gravity by straps and a corset in a frame. The patient is immobilized by transverse arms with end pads which engage the torso, and lateral shear forces are applied to the spinal column by a transversely extending power-operated pusher.

8 Claims, 4 Drawing Sheets

PROCESS AND APPARATUS FOR PHYSIOTHERAPY IN SCOLIOSIS AND DEVIATIONS OF THE RACHIS IN GENERAL

BACKGROUND OF THE INVENTION

This invention relates to a process and apparatus for treating scoliosis and deviations of the human spinal column in general.

The morphology of the human spinal column at present transmits the effect of the modulating forces which have operated on it and continue to influence it. The spinal column has not finished evolving, and this is the case when morphological traces resulting from the myotendinous tension produced by the weight of the body and the action of the force of gravity can be detected in the osseous structures. The mechanisms which generate tension affecting the spinal column are increased by the effort people put forth to adapt to different environments and ways of life.

The lateral deviation, or deviation in the coronal plane of the spinal column, is specific to man. We can say that scoliosis emerged when our ancestors became bipedal, and therefore, we must recognize that one factor which has determined man's predisposition to contract scoliosis is the different biomechanics of his spinal column.

In bipedal condition each vertebral unit receives and supports, in proportion to the height it occupies, an extraordinary force of compression in relation to that endured in the quadrupedal position, as all of the weight is transmitted vertically until finally resting on two points of support: the feet.

The exact geometric design of each of the vertebrae has been structured directly related or proportional to the force of compression it supports.

The lumbar vertebrae are larger and more solid than the vertebrae in the dorsal region, which support less weight, and in turn, are larger than the cervical vertebrae.

The interdiscal pressure in the case of man's bipedal condition may vary in function of the location of his center of gravity and the leverage of his arms which he adopts with his upper extremities and torso. The different activities performed by the human being give rise to a multitude of changes in intervertebral pressure and localization. Changes in the position of the individual, for example, may result in a disk having to support 58 $kg/cm^2$ due to a change in the position of the trunk, after having previously supported 15 $kg/cm^2$ in the preceding supine position, while the dorsal articulations may be subjected to a shear force of 47 kg.

We clearly understand that one of several, or all of the elements stabilizing the spinal column may be affected by any circumstance, whether it be internal or external, and thus upset the balance of the spinal column.

Nevertheless, despite the studies carried out up to now, the pathogenesis of idiopathic scoliosis is still not exactly known. As far as the treatment of scoliosis is concerned, there is not in general any uniformity in the guidelines for treatment to be followed.

The present invention was conceived after prolonged, careful study and experimentation in the physical therapy treatment of scoliosis and deviations of the rachis in general. The conclusions which follow below are the result of the study and experiments referred to above, which were conducted on rabbits, although the rabbit is a quadruped, while man is a biped, just as the biomechanical conditions of the two animals are very different from each other, as we have explained above. In any event, it is a fact that the properly applied corrective techniques will model the developing bone, thus preventing its progressive deformation.

From the studies and experiments that have been carried out, the following conclusions have been drawn: manual corrective techniques properly applied during the period of bone growth and development, are effective in the treatment of scoliosis.

During the growth period, the bone can be deformed by the forces of traction and compression exerted on it.

The constant compression to which the fibrocartilaginous invertebral disks are subjected during the growth period of this tissue, are capable of modifying it and altering its development.

Trophism of the bone and fibrocartilaginous tissue is significantly altered by the action and effect of the forces of compression exerted on them.

Current physical therapy treatment not only serves to fortify and tone the muscles, or as a coadjutant means accompanying other techniques; it is also effective, per se, in the treatment of scoliosis in individuals in the growth period, as it structurally modifies the behavior of the curves.

SUMMARY OF THE INVENTION

The process and the apparatus according to the invention, tend to reproduce in the human spinal column dynamic effects similar to those experimentally produced in the rabbits; in addition, the proposed apparatus was specially designed to operate with enough precision to determine the correct dose of force in relation to the proprioception experienced by the patient.

The apparatus basically features a chassis or frame formed by a structure made up of movable horizontal and vertical sections, which in turn support elements for sustaining a patient who is to be treated, along with various other means for treating the patient by immobilizing him both vertically and horizontally and allowing for the three dimensional setting of the rachis in elongation with adjustable disrotatory corrective pressure, intermittent or continuous and automatic posture control, in order to be able to subsequently treat the patient in such a way that he receives pressure applied to his sides, right or left, which produces forces of elongation and shear forces on the spinal column, such forces being controlled with respect to time and intensity, and constituting the basis of the treatment.

The means of sustaining the patient may comprise a set of straps, which, with the help of a padded corset, make it possible to suspend the patient from a vertical cross piece, which, in turn, is equipped with the respective means for permitting ascent and descent, in order that the patient may be positioned at the vertical height necessary for the pressure applying means, given that patients present varying degrees of scoliosis and deformations in general, in different areas, and that in addition, these patients may be of different heights.

The means of immobilizing the patient to the apparatus may consist of three horizontal rails or arms at the end of which are located a set of curved sections which are equipped with a flexible covering and, when properly regulated, immobilize the patient from in front, from behind, and/or from the right or from the left, where the therapeutic action is exerted by means of a pusher equipped with mechanisms for impulsion and regulation. The pusher is made up of a horizontal axle or piston at the end of which is the pushing element which is coated with a flexible material to prevent injuring the patient.

Other details and characteristics of this invention will be set forth in the course of the description which is provided below and which makes reference to the drawings accompanying this description, which represent the preferred details in a rather schematic manner. These details are provided to serve as an example, making reference to one possible case of practical embodiment, but it is not limited to the details set forth there. Therefore, this description should be considered illustrative, containing no limitations of any type.

DESCRIPTION OF PREFERRED EMBODIMENT

Figure 1:
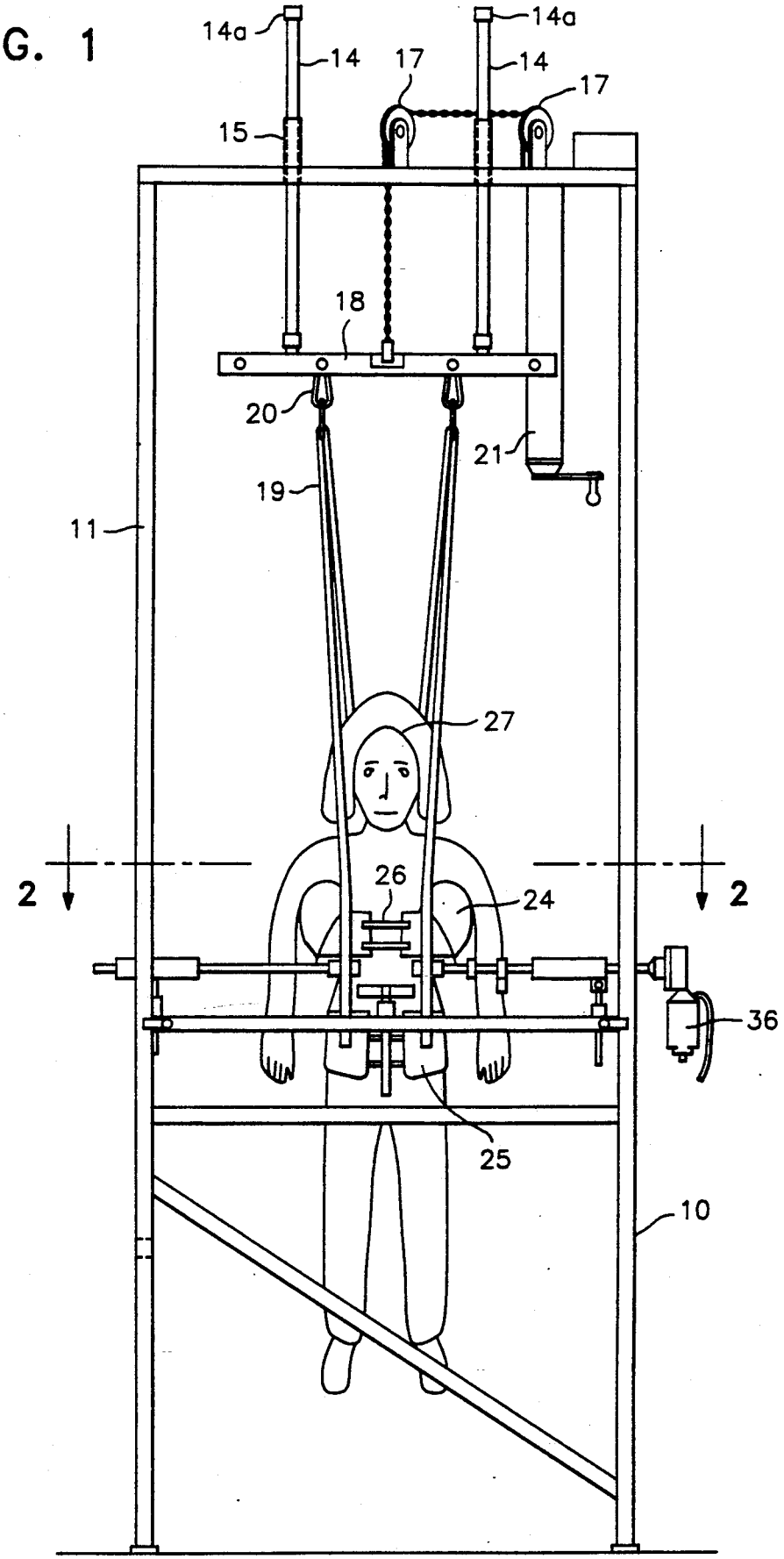
FIG. 1 is a front elevational view of apparatus according to the invention.

FIG. 1 is a front elevation of the machine (10) in working position, into which a patient (27) has been placed, suspended by means of a corset or harness (25) from or a cross bar (18), and immobilized on the inside of the apparatus by the corresponding horizontal sections (22), to the ends of which are soldered immobilizing members or plates (13).

Figure 2:
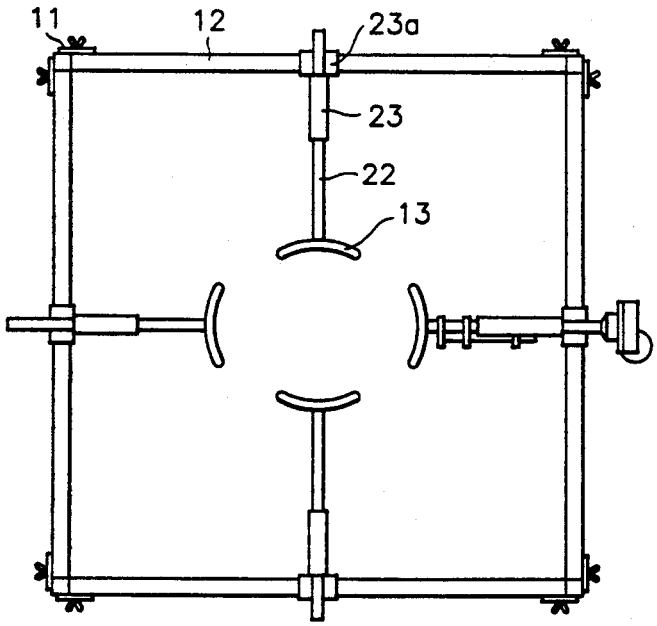
FIG. 2 is a sectional view of the apparatus on lines 2—2 of FIG. 1.

FIG. 2 is a top view of the apparatus (10), in which is shown how the structure of the apparatus (10) is formed beginning with the horizontal sections (12) and vertical sections (11) and means of locking sections (12) to (11).

Figure 3:
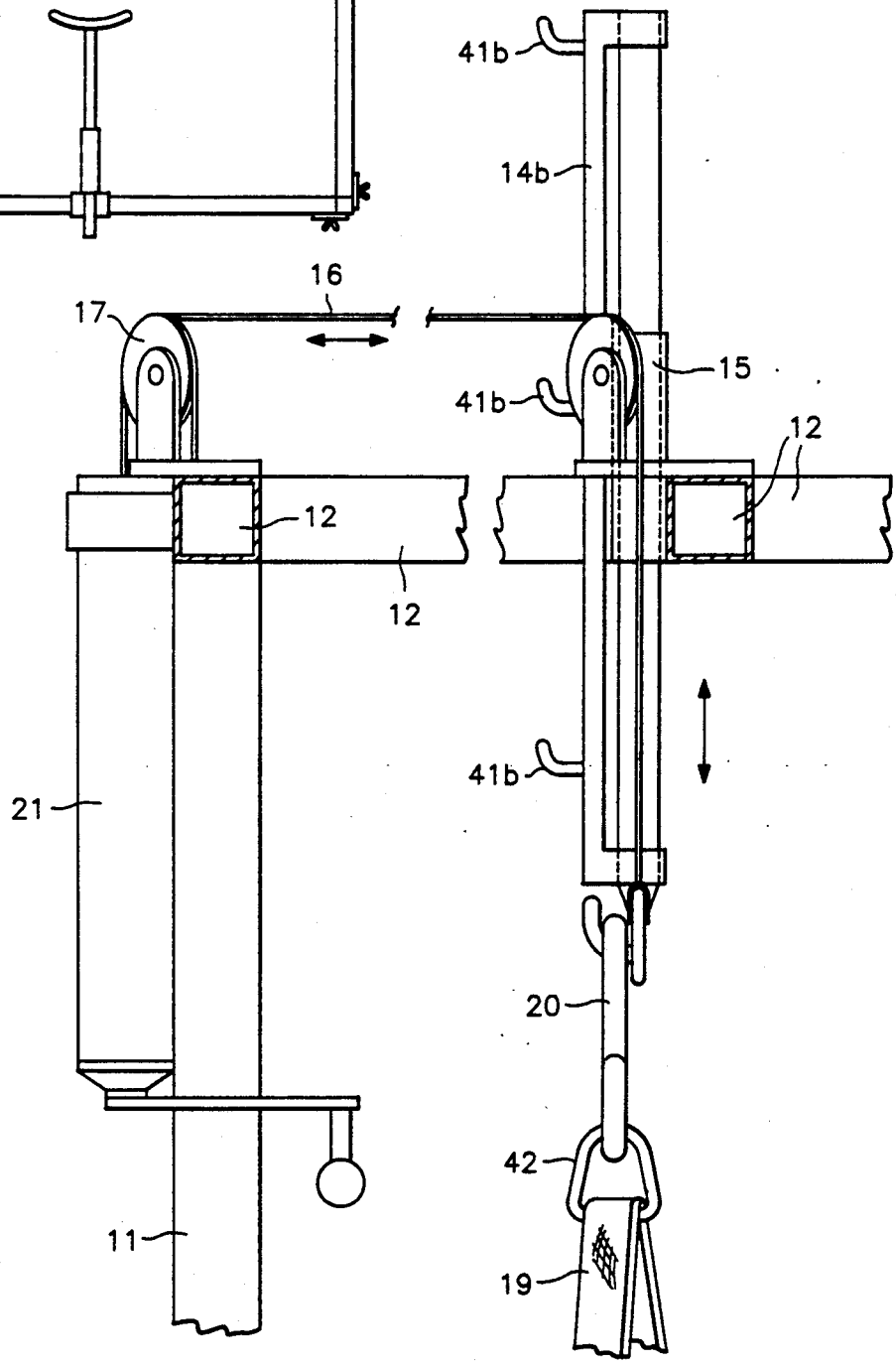
FIG. 3 is an enlarged side elevational view partly in section of a part of the apparatus.

FIG. 3 is a partial side elevation with detail of the elements which sustain the patient (27); these elements comprise a set of straps (19) which hang from rings (42), which in turn are hung from a karabiner (20). The entire assembly is suspended from a series of hooks (41) distributed at different heights on the sections (14*b*) and secured to the sections (14). The patient is raised and lowered (27) by means of a cable (16) and a set of two pulleys (17) which connect the cable (16) to the cross piece (18).

Figure 4:
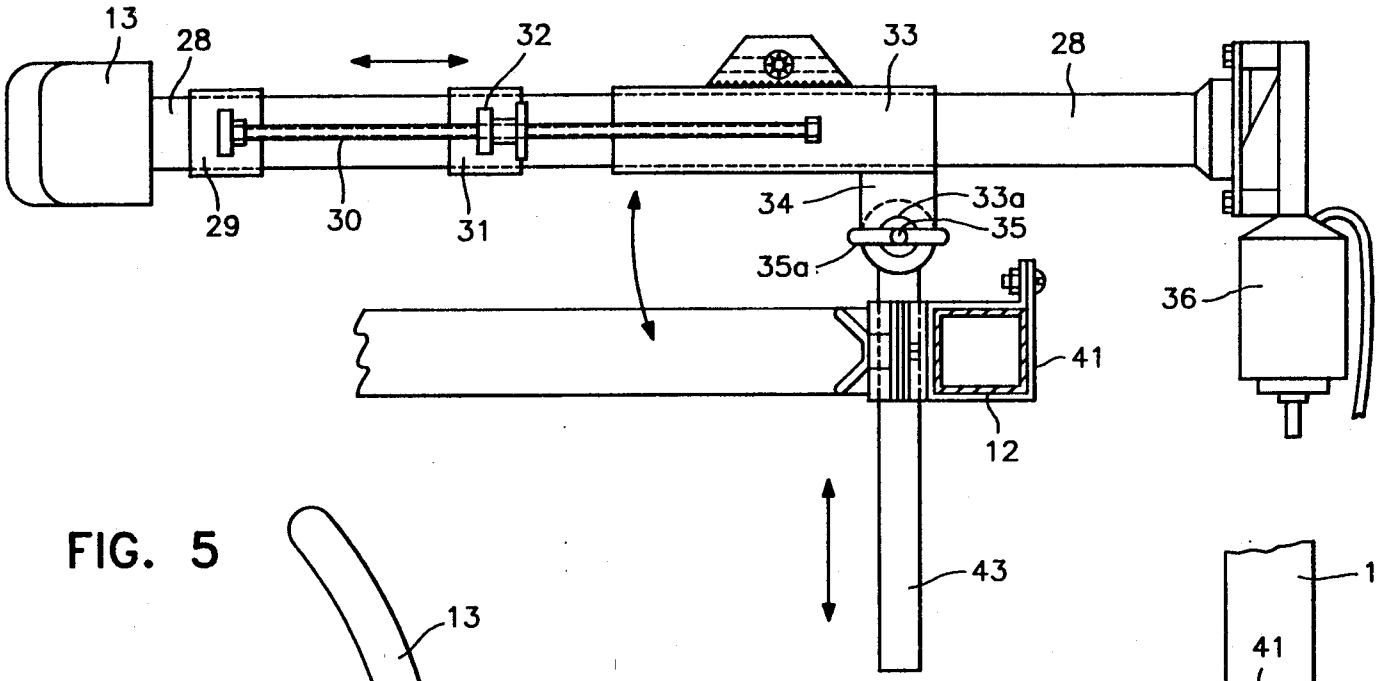
FIG. 4 is an enlarged side elevational view partly in section of another part of the apparatus.

FIG. 4 is a partial side elevation of the means for the therapeutic treatment of the patient (27) by shear forces generated by means of an impeller (36) on the one section (13).

Figure 5:
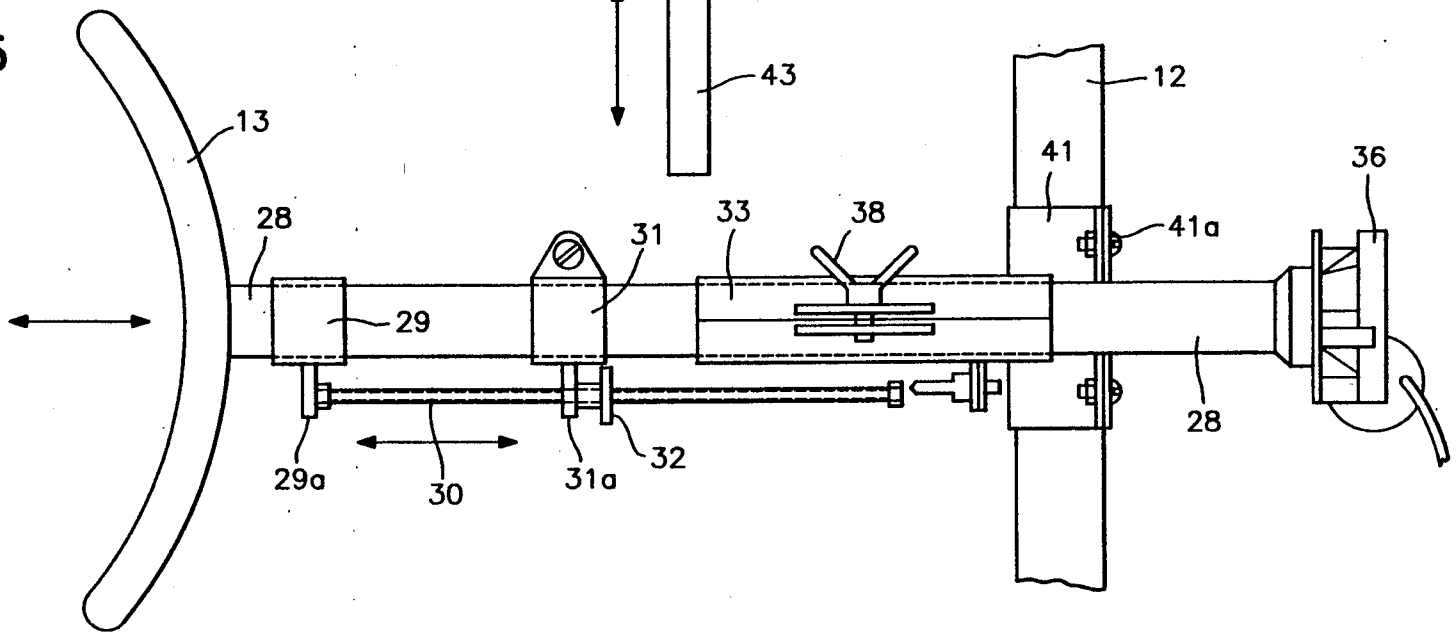
FIG. 5 is a plan view of that part of the apparatus shown in FIG. 4.

FIG. 5 is a top view corresponding to FIG. 4, in which is shown the impeller element (36) which acts on the axle rod (28) to the end of which a pusher section (13) is soldered.

Figure 6:
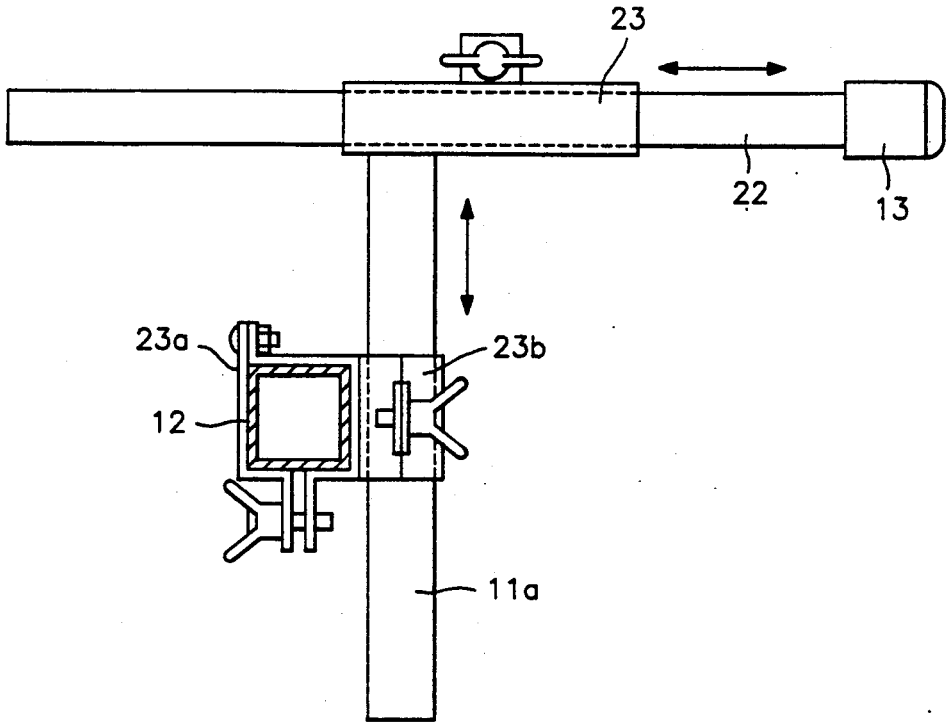
FIG. 6 is an elevational view of an adjustable part of the apparatus.

FIG. 6 is a top sectional view of a detail of the possible movements of the sections (22) by means of the boxes (23), (23*a*) and (23*b*), the latter of the three boxes being mounted on the sections (11*a*) and (12).

Figure 7:
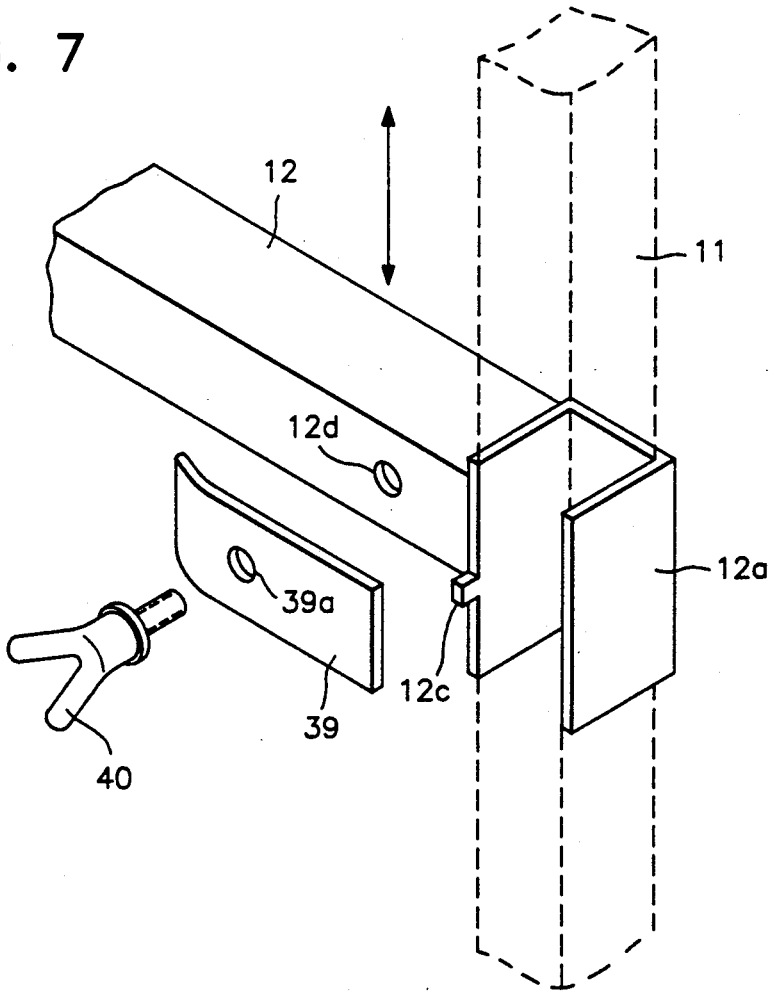
FIG. 7 is an exploded perspective view of another adjustable part of the apparatus.

FIG. 7 is a side view with a detail of the system for attaching the sections (12) to the sections (11).

In more detail as can seen in FIGS. 1 and 2, the proposed apparatus comprises a structure formed by vertical sections or rails (11), over which a set of sections are assembled, forming horizontal cross pieces (12) forming a sub-frame. These cross pieces (12) can be moved vertically upward or downward, guided by the vertical sections (11).

The system for locking sections (12) to sections (11) can be seen in FIG. 7, which shows that at the end of a cross piece (12), a box (12*a*) with the shape of a quadratic prism without the smaller bases and missing one of the larger plane surfaces. This box (12*a*) fits around the section or rail (11), (12*a*) and (11) having been positioned in practically in the same transverse section fixing (12) to (11) by means of the flat, rectangular iron plate (39), which is slightly folded forward at the end and fitted into the section (12) by means of the flanged screw (40), which passes through the perforation (39*a*), the iron plate (39) and the threaded hole (12*d*) of the horizontal cross piece (12), so that the stub (12*c*) which protrudes from one of the surfaces of the box (12*a*) impedes the descent of (12) with respect to (11), as this stub (12*c*) impedes the descent of (12) and of the iron plate (39) fixed to (12).

The elements for immobilizing the patient (27) are assembled on the horizontal cross pieces (12). As can be seen in FIG. 6, these elements are formed by a set of rails (22) which slide through the boxes (23), the ends of the rails (22) being soldered to the corresponding sections or plates (13), bearing a slightly curved shape and covered with the corresponding flexible material so as to prevent harm to the patient (27). The positioning of the sections (13) may also be regulated by means of the boxes (23*a*) which can be moved horizontally, to the left and to the right, all along the horizontal cross piece (12), which in turn is moved by the vertical cross pieces (11*a*), by means of the box (23*b*) which slides over (11*a*).

The mobility of the sections (13), in both the horizontal and vertical directions, is insured by the placement of these sections (13), described in the preceding paragraph, so that their positioning is adapted to the constitution of the patient (27) as well as to the area of the spinal column (27) which is being treated.

The effectiveness of the therapeutic treatment is based on the process of operation of the apparatus (10) and on both its moving and stationary or structural parts. One of its operations, as can be seen in FIGS. 4 and 5, is facilitated by an arm (28) which moves forward, pushing the section (13) soldered at the end. The force required to move arm (28) back and forth is generated by the element (36), which may be of any type of medium, either electrical or pneumatic. At the same time, the means of regulating both the time and intensity of the force exerted by (28) can be controlled, while (36), in turn, is controlled differently, for example by means of a computer and program, which store in the computer memory the therapy to be given to a particular patient. All of this is aimed at controlling the intensity of the force, mentioned above, to be exerted on members (13–28) in function of the type and severity of the scoliosis or other deformations of the rachis which the patient may develop.

Given that patient (27) may vary in size, both in width and in height, and that the size of the area to be treated may also vary, the element of therapeutic action which has been described and is shown in detail in FIGS. 4 and 5, is equipped with means for limiting the throw as well. These consist in the threaded rod (30)

which positions the movable box (29) so that it serves to limit the throw of the axle (28). The position of (29) is adjusted, backward and forward by means of the safety threading (32) which in turn is limited by the stationary box (31).

The positioning of members (13–28) can be regulated in the vertical direction by means of the box (33) which is fastened with the wing nut (38) to the binomial members (13–28), which allows for horizontal changes in position by means of the angular piece (34) connected to (33) by means of the perforation (33*a*), the axle of rotation (35) and the wing nut (35*a*) which positions members (13–28) at the desired angle.

The positioning of the patient will also be a function of the area to be treated, and therefore, in relation to this as well as to the patient's height and width, it should be possible to control his position with respect to the apparatus (10), which for this purpose is equipped with a controllable means of support, made up of the horizontal cross piece (18) which is held in place by the vertical rails (14) with restriction of throw (14*a*). The vertical movement of the cross piece (18) is controlled by means of a regulator (21), which limits the length of the cable (16), which is drawn by way of the pulleys (17) so that by means of (21) we can move the horizontal cross piece (18) up and down, and the patient (27) along with it.

So that the patient (27) can remain suspended from the apparatus (10) in the correct position for therapy, she is fitted with a vest (25) which is cut below the level of the forearms and equipped with immobilization elements (26) and with arm supports (24) which provide cushioning in order to prevent the vest (25) from causing injury to the patient (27). The vest (25) is connected to the horizontal cross piece (18) by means of straps (19) which hang from rings (42), which in turn are suspended from karabiners (20).

Preparation of the patient (27) for treatment is carried out, first of all, by setting her in the apparatus (10), placing the vest on her (25) in order to subsequently adjust the height of suspension by means of (21), until the patient is positioned in such a way that the immobilizing sections (13) can be placed on her at the proper height, and thus the treatment can be initiated according to the process described above, with shear forces exerted on the spinal column of the patient (27) and generated by the device (36) which in turn, can be programmed by means of a personal computer and the corresponding program adapted to the apparatus and the therapy.

It is evident that the apparatus described comprises a whole unit with the process of operation not amenable to separate functioning.

Having sufficiently described the contents of this Patent and the corresponding drawings attached, it is understood that any modifications thereof may be introduced in as much detail as is considered necessary as long as the essence of the invention, summarized in the following claims, is not altered.

I claim:

1. Apparatus for treating scoliosis and deviations of the human spinal cord in general comprising an upright main frame, suspension means for suspending a patient in the main frame under gravity, immobilization means connected with the main frame for gripping the patient's torso to substantially immobilize the patient when suspended and force-applying means associated with the main frame for applying a substantially horizontally directed pressure force to a selected area of the patient's spinal cord while the patient is suspended and immobilized, wherein the suspension means includes a cross-bar attached to the frame, a patient-fitting harness, and straps suspending the harness from the cross-bar.

2. Apparatus as claimed in claim 1 wherein the cross-bar is attached to the main frame by a height adjustment mechanism.

3. Apparatus as claimed in claim 2 wherein the height adjustment mechanism comprise a cable having one end connected to said cross-bar, the cable extending over pulley means mounted on an upper member of the main frame and the cable having another end connected to winching apparatus.

4. Apparatus as claimed in claim 3 including guide rods on the cross-bar extending through bushings on said upper member of the main frame.

5. Apparatus as claimed in claim 1, wherein the immobilization means comprises a plurality of length adjustable horizontal rods mounted on the main frame, each rod having an inner end with a torso-engaging plate thereon and wherein the force-applying means comprises a pusher assembly including a horizontal rod having an inner end with a torso-engaging plate and means for reciprocating the rod.

6. Apparatus for treating scoliosis and deviations of the human spinal cord in general comprising an upright main frame, suspension means for suspending a patient in the main frame under gravity, immobilization means connected with the main frame for gripping the patient's torso to substantially immobilize the patient when suspended and force-applying means associated with the main frame for applying a substantially horizontally directed pressure force to a selected area of the patient's spinal cord while the patient is suspended or immobilized, wherein the immobilization means comprises a plurality of length adjustable horizontal rods mounted on the main frame, each rod having an inner end with a torso-engaging plate thereon, wherein said rods are mounted on a horizontal sub-frame and the sub-frame is mounted for height adjustment on upright members of the main frame, wherein the force-applying means is mounted on the sub-frame, and wherein the force-applying means comprises a pusher assembly including a horizontal rod having an inner end with a torso-engaging plate and power means for reciprocating the rod.

7. Apparatus for treating scoliosis and deviations of the human spinal cord in general comprising an upright main frame, suspension means for suspending a patient in the main frame under gravity, immobilization means connected with the main frame for gripping the patient's torso to substantially immobilize the patient when suspended and force-applying means associated with the main frame for applying a substantially horizontally directed pressure force to a selected area of the patient's spinal cord while the patient is suspended and immobilized, wherein the force-applying means comprises a pusher assembly including a horizontal rod having an inner end with a torso-engaging plate and power means for reciprocating the rod.

8. Apparatus as claimed in claim 7 wherein the force-applying means is mounted on a horizontal sub-frame and the sub-frame is mounted for height adjustment on upright members of the main frame.

* * * * *